US008545973B2

(12) United States Patent
Smolko et al.

(10) Patent No.: US 8,545,973 B2
(45) Date of Patent: Oct. 1, 2013

(54) SEALABLE CONTAINERS

(76) Inventors: Daniel D. Smolko, Jamul, CA (US); Gregory J. Kevorkian, Temecula, CA (US)

( * ) Notice: Subject to any disclaimer, the term of this patent is extended or adjusted under 35 U.S.C. 154(b) by 840 days.

(21) Appl. No.: 12/404,247

(22) Filed: Mar. 13, 2009

(65) Prior Publication Data

US 2009/0230079 A1 Sep. 17, 2009

Related U.S. Application Data

(60) Provisional application No. 61/069,377, filed on Mar. 15, 2008.

(51) Int. Cl.
*B65D 51/16* (2006.01)
*B65D 53/00* (2006.01)
*B32B 15/08* (2006.01)

(52) U.S. Cl.
USPC ..... 428/306.6; 428/304.4; 220/359.1; 220/359.3; 220/361; 220/364; 220/363; 220/367.1; 215/261; 215/233; 215/248; 215/347; 215/307

(58) Field of Classification Search
USPC ..... 220/359.1, 359.3, 361, 364, 363, 220/367.1; 215/261, 233, 248, 347, 307; 428/306.6, 304.4
See application file for complete search history.

(56) References Cited

U.S. PATENT DOCUMENTS 2,997,397 A * 8/1961 Alcibiade ..... 426/402
3,951,293 A * 4/1976 Schulz ..... 215/261
4,174,784 A * 11/1979 Hartung ..... 215/349
4,596,338 A * 6/1986 Yousif ..... 215/232
4,666,052 A * 5/1987 Ou-Yang ..... 215/230
4,689,936 A * 9/1987 Gaikema et al. ..... 53/440
4,733,786 A * 3/1988 Emslander ..... 215/230
4,756,437 A * 7/1988 Rossi-Mossuti ..... 215/230
4,863,051 A * 9/1989 Eibner et al. ..... 215/261
5,057,365 A * 10/1991 Finkelstein et al. ..... 428/344
5,307,985 A * 5/1994 Beizermann ..... 229/120
5,590,778 A * 1/1997 Dutchik ..... 206/439
5,665,408 A * 9/1997 Coupe et al. ..... 426/113
5,730,306 A * 3/1998 Costa et al. ..... 215/261
5,759,668 A * 6/1998 Ishikawa et al. ..... 428/137
5,988,426 A * 11/1999 Stern ..... 220/371
6,182,850 B1 * 2/2001 Marbler et al. ..... 220/359.3
6,398,048 B1 * 6/2002 Kevorkian ..... 215/11.5
6,416,831 B1 * 7/2002 Hara et al. ..... 428/34.6
6,602,309 B2 * 8/2003 Vizulis et al. ..... 55/385.4
6,983,857 B2 * 1/2006 Miller et al. ..... 215/270
7,621,412 B2 * 11/2009 Raniwala ..... 215/261
7,909,192 B2 * 3/2011 Dempsey et al. ..... 220/203.03
2003/0000907 A1 * 1/2003 Kevorkian et al. ..... 215/11.5
2004/0173556 A1 * 9/2004 Smolko et al. ..... 215/11.5
2004/0265447 A1 * 12/2004 Raniwala ..... 426/397

(Continued)

FOREIGN PATENT DOCUMENTS

GB 1146972 A * 3/1969

*Primary Examiner* — Michele L Jacobson
(74) *Attorney, Agent, or Firm* — Gary L. Loomis; G. L. Loomis & Associates, Inc.

(57) ABSTRACT

The present invention relates to containers suitable for uses such as liquid hot-fill processes. More specifically the invention relates a containers having gas permeable vents with an integral sealing means that is externally activatable by non-mechanical means to effect hermetic sealing of the containers after filling.

35 Claims, 6 Drawing Sheets

(56) References Cited

U.S. PATENT DOCUMENTS

2005/0263479 A1* 12/2005 Smolko et al. ..... 215/308
2005/0263480 A1* 12/2005 Smolko et al. ..... 215/308
2009/0148941 A1* 6/2009 Florez et al. ..... 435/325
2009/0152272 A1* 6/2009 Guptil ..... 220/361
2010/0175850 A1* 7/2010 Kaucic et al. ..... 165/59

* cited by examiner

SEALABLE CONTAINERS

RELATED APPLICATION DATA

This application claims priority under 35 U.S.C. §119(e) to U.S. Provisional Application Ser. No. 61/069,377 filed Mar. 15, 2008.

FIELD OF THE INVENTION

The invention relates to sealable containers and sealing methods and more particularly to containers and methods for hot-filling beverages.

BACKGROUND

In the packaging industry many factors drive the use of plastic containers and closures for various applications including hot-fill applications. Such factors include the continuing migration of beverage packaging as well as other packaging from glass containers to plastic containers, the increasing use of single-serve sizes and the proliferation of juice drinks, nectars, energy drinks and other nutritious beverages. The hot-fill process is essentially a packaging process employed to extend shelf life of the product. Such packaging systems allow products containing even highly perishable ingredients such as milk to be stored without refrigeration for extended periods. Efficient closures are the first line of defense against microbial contamination that would compromise that product shelf life, however closures have been one of the most difficult aspects of totally plastic packaging to incorporate into filling applications such as hot-fill systems. In current beverage hot-fill processing, vacuum develops in the container as a result of cooling of headspace gases in a hermetically sealed closure/container system. The ensuing pressure differential is often strong enough to cause severe container deformation, which is unacceptable to the consumer. To avoid such deformation most plastic beverage bottles are designed with greater thicknesses and collapsible panel geometries to accommodate the volume changes caused by internal vacuum formation. As a result, these dedicated hot-fill beverage containers are significantly more expensive compared to sterile-fill and other containers due to the increased plastic material required for their fabrication. Also, as closure designs are refined, bottlers have the option of eliminating process steps to make operations more efficient and less costly. Newer hot-fill closure systems that alleviate hot-fill limitations are being designed. For example, the PCT application published as WO 2006/053013 to Trude et al. describes a seal with a physically moveable portion useful for hot-fill and pasteurizable bottles. The moveable portion of the seal moves in response to pressure created in a container during the processes of hot-fill and pasteurization and accommodates changes in pressure within the container and prevents ambient air from passing into the container.

United States Patent Application 2004/0265447 to Raniwala describes a method of hot-filling a plastic bottle wherein the bottle is provided with an air permeable membrane-covered hole used to equalize pressure between the interior of the container and the ambient pressure as the bottle and contents cool, after which a seal is mechanically and independently applied over the membrane-covered hole. However, since the sealing means is not an integral part of the device and requires a mechanical step the method does not readily lend itself to an overall automated and rapid hot-filling process. U.S. Pat. No. 7,143,568 to Van Heerden et al. discloses a method for sealing a container that includes a crushable material that is mechanically deformed to effect a seal. Since, such a method does not provide gas venting of the container it not applicable to the filling applications addressed by the containers of the present invention.

Therefore, a need exists for improved methods and container for hot-fill processes wherein a vented container also have an integral capability to self-seal via non-contact or direct contact means, rendering the container system hermetically sealed at the conclusion of the filling process.

A need also exists for improved sealable, vented retort pouches for packaging a variety of perishable foodstuffs.

A further need exists for sealable, vented containers that are pressurizable with a gas such as nitrogen or carbon dioxide prior to sealing.

A still further need exists for sealable, vented containers having a visual indicator activated by the sealing process, wherein the indicator shows that the container has been sealed.

The devices and methods of the present invention address these and other needs.

SUMMARY OF THE INVENTION

The present invention provides sealable containers suitable for uses including, but not limited to, liquid hot-fill processes. The container comprises a container body which is formed by a wall defining and separating an interior space from the exterior environment, wherein the container body has at least one a closable opening; a container closure means mated to the closable opening and a gas permeable vent component providing gaseous communication between the interior space of the container body and the exterior environment, wherein the vent component comprises a vent component sealing element that is externally activatable to effect hermetic sealing of the container. Such external activation is non-mechanical and requires only radiative contact with the sealing elements and/or components of the container. In certain preferred embodiments the gas permeable vent component is disposed within the container closure means while in other preferred embodiments the gas permeable vent component is disposed within in the wall of the container body. In certain embodiments the gas permeable vent component is a porous matrix or porous membrane, which can be hydrophobic, hydrophilic, oleophobic or oleophilic. In certain embodiments the porous matrix is fabricated from a polymer such as a polyolefin or fluorinated polyolefin. A list of suitable polyolefins includes, but is not limited to, polyethylenes polypropylenes, ethylene/propylene copolymers, polybutylenes, polymethylpentenes, copolymers thereof and combinations thereof. A particularly suitable fluorinated polyolefin is polytetrafluoroethylene, which is readily avoidable in the form of a porous matrix or porous membrane. In certain other embodiments the porous matrix or membrane is fabricated from ethylene copolymers including, but not limited to, ethylene/vinyl acetate copolymers, ethylene/vinyl alcohol copolymers and polyvinyl acetates as well as alloys, mixtures and combinations thereof.

In certain embodiments the porous matrices or porous membranes of the vent components have a pore diameter range of 1 μm to 350 μm with 5 μm to 40 μm being preferred. While in certain other embodiments the porous matrices or porous membranes of the vent components have a pore diameter ranging from 0.01 μm to 5.0 μm with 0.05 μm to 2.0 μm preferred and 0.10 μm to 0.20 μm most preferred.

In certain embodiments the vent component sealing composition is a porous fusible material, which in certain embodiments is disposed directly above or below the porous matrix and in certain preferred embodiments is in intimate contact with the porous matrix. In certain other embodiments the vent component has a laminate structure wherein the vent component sealing composition is disposed between a first porous matrix and a second porous matrix. In certain embodiments the porous fusible material is a thermoplastic and in certain preferred embodiments such a thermoplastic is a hot-melt adhesive, which in certain embodiments comprises an energy absorbing material such as a metal or other such adhesive activator. In some embodiments the energy absorbing material is an electrically conductive metallic material and in certain preferred embodiments such a metallic material comprises iron, steel, aluminum, titanium, zinc, copper or silver. In certain embodiments wherein the porous fusible material comprises a metal or metallic composition the sealing element is externally activatable by an electromagnetic induction source operating at a frequency ranging from 5 kHz to 100 GHz. In certain preferred embodiments the fusible sealing element is externally activatable by an electromagnetic induction source operating at a frequency ranging from 5 kHz to 900 MHz. In yet certain other preferred embodiments the fusible sealing element is externally activatable by an electromagnetic induction source operating at a frequency ranging from 800 MHz to 100 GHz.

In certain embodiments the metallic composition is in the form of a porous metal foil and the sealable container of has a laminate structure comprising a vent fusible sealing composition, a first porous matrix, a second porous matrix and a porous metal foil disposed such that the fusible sealing composition is in intimate contact with the porous metal foil. In certain other embodiments the metal or metallic composition is in the form of a thin coating deposited on a suitable porous film, while in yet other embodiments the energy absorbing metal is in the form of macroparticles or microparticles dispersed throughout the porous fusible material.

In certain embodiments the vent component sealing composition comprises an adhesive composition curable by exposure to ultra violet (UV) radiation, wherein such an adhesive composition is cured by a photochemical reaction. In still other embodiments the vent component sealing composition comprises an adhesive curable by electron beam (EB) radiation.

Also provide by the present invention is a method for hot-filling and sealing a container comprising the steps of: providing a container as herein described; filling the container with hot liquid; allowing the liquid to cool to desired degree and then externally activating the vent component sealing composition by non-mechanical means to effect hermetic sealing.

The art described herein is not limited to filling applications and can be applied to any container application that requires a self-sealing vent disposed within any surface of the container including the closure. Applications may also include venting, venting and sealing, vacuum and sealing and pressurization sealing as well as lyophilization and sealing. Additional applications may include venting after sealing as well by using reversible sealing mechanisms such as pull tabs, removable plugs and meltable seals that can be removed from vent areas by mechanical means, capillary absorption into adjacent materials, application of pressure or vacuum, and/or thermal means. A suitable container may or may not contain a discreet closure component. For example a plastic, glass or metal bottle typically contains a cap or closure on top. A retort pouch or bag may be sealed completely but not necessarily contain a cap or closure. In addition a closure can be any attached component or part of a container used to cap, seal, encapsulate or gain access to the contents of said container.

Figure 1:
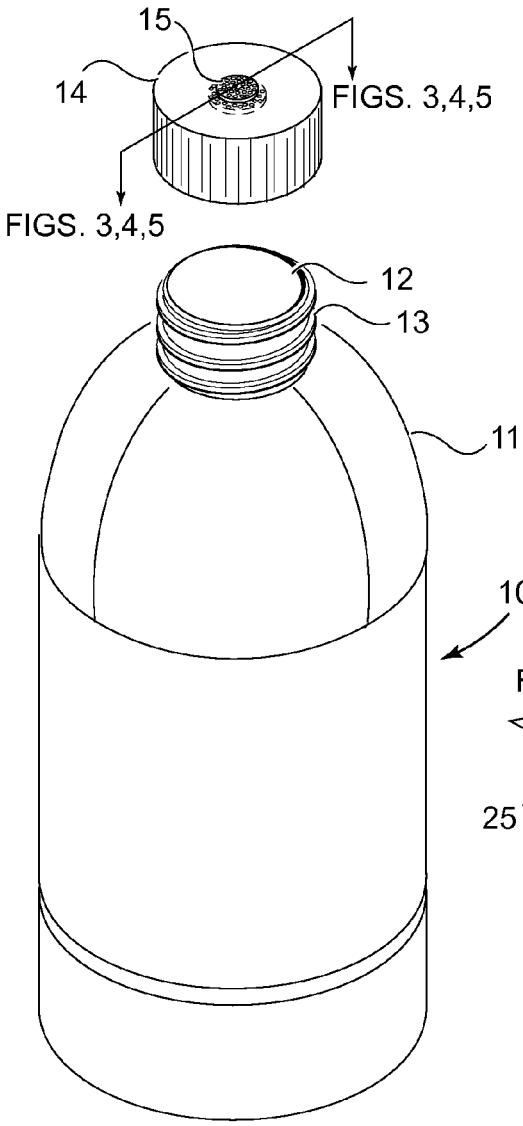
FIG. 1 depicts an isometric view of an embodiment of a sealable container wherein a sealable vent component is disposed within the container cap.

Although the figures presented herein illustrate some preferred embodiments, they are intended to be merely exemplary and representative of certain embodiments. To that end, several figures contain optional features that need not be included in any particular embodiment of the invention. Furthermore, the shapes, types, or particular configurations of the various elements of the illustrated devices should not be regarded as limiting to the invention.

DETAILED DESCRIPTION

For the purposes of the invention described in this application, certain terms shall be interpreted as shown below.

Fusible materials are materials that either melt or soften upon the application of heat and re-solidify or re-harden upon subsequent cooling.

Induction heating is a non-contact heating process wherein an electrically conducting material is heated by electromagnetic induction via eddy currents generated within the conducting material and wherein electrical resistance effects to Joule heating. An induction heater for any process consists of an electromagnet through which a high-frequency alternating current (AC) is passed. Heat may also be generated by magnetic hysteresis loss in materials that have significant relative permeability. The frequency of AC used depends on factors such as the object volume, specific material type, coupling distance between the electromagnet and the material to be heated and the desired penetration depth.

Macroporosity refers to the overall void volume of a material and classifies individual pores that are considered large in size and have a pore diameter >0.050 μm as classified according to the International Union of Pure and Applied Chemistry (IUPAC) Subcommittee of Macromolecular Terminology, definitions of terms drafted on Feb. 26, 2002.

Microporosity refers to the individual pore sizes or distribution of pore sizes that constitute the microstructure of a porous material and classifies individual pores that are considered small in size and have a pore diameter <0.002 μm as classified according to the International Union of Pure and Applied Chemistry (IUPAC) Subcommittee of Macromolecular Terminology, definitions of terms drafted on Feb. 26, 2002.

Mesoprosity refers to the individual pore sizes or distribution of pore sizes that constitute the microstructure of a porous material and classifies individual pores that are considered medium in size and have a pore diameter between 0.002 to 0.050 μm as classified according to the International Union of Pure and Applied Chemistry (IUPAC) Subcommittee of Macromolecular Terminology, definitions of terms drafted on Feb. 26, 2002.

Void volume of a material is synonymous with percent porosity.

Certain embodiments of the devices and processes of present invention provide means for the efficient hermetic sealing of containers, while other embodiments provide means for partial sealing and/or reversible sealing of containers.

Various embodiments of devices of the present invention comprise venting orifices; venting seals; venting conduits such as holes; channels and threads; as well as porous matrices and porous membranes. The porous membranes can be microporous, mesoporous or macroporous. The sealing can be effected by a variety of means including, but not limited to, physical contact, compression, spin welding, electrical induction, electrical current, electromagnetic radiation, heating with a hot probe, ultrasonic radiation, infrared radiation, laser beams and the like. A variety of materials are useful for creating the seal in sealing devices of the present invention including, but is not limited to, adhesives, glues, hot melts, waxes, thermoplastics, thermoplastic elastomers and the like. The extent of sealing as well as the reversibility of the seal depends upon the penetration of the seal material into the other materials comprising the device as well as to the degree of chemical or physical bonding of the seal material into the other materials comprising the device.

Sterilization of the vent areas prior to, during or after sealing can be effected by a variety of standard sterilization processes including but not limited to, thermal, ultra-violet irradiation, electron beam irradiation gamma-irradiation, beta-irradiation, bactericides, chemical sterilants/disinfectants such as hydrogen peroxide and the like.

Certain embodiments of the present invention are applicable to beverage hot fill processes. In a typical process, following hot filling of a hermetically sealed closure/container system a vacuum exists within the container as a result of headspace cooling. The ensuing vacuum is strong enough to cause severe container deformation of the container, which is unacceptable to the consumer. To avert this problem most plastic beverage bottles are designed with heavier wall thicknesses and collapsible panel geometries to accommodate the volume changes caused by internal vacuum formation. As a result, these dedicated hot-fill beverage containers are significantly more expensive compared to sterile-fill and other containers due to increased plastic material usage and special container designs.

Certain embodiments of the present invention are applicable to liquid fill processes wherein the liquid filled container is pressurized via the vent components prior to sealing. In certain embodiments addition pressurization with an inert gas such as nitrogen, carbon dioxide and the like is utilized to provide additional container integrity (further reducing plastic usage) and to provide enhanced inertness for beverage flavor preservation and extended shelf life. In alternate applications vacuum or combinations of vacuum followed by pressurization are applied to the filled container before sealing to completely remove any traces of air, oxygen, water vapor or other undesired gases or volatile fluids prior to sealing.

Embodiments of the present invention employ a sealable, vented closure and obviate the need for traditional bulky hot-fill bottles. In certain preferred embodiments a sealable container for liquids consists of a container body, which is formed by a wall, wherein the container body has a closable opening and a container closure cap mated to the closable opening; a gas permeable vent component providing gaseous communication between the interior of the container body and the exterior environment, wherein the vent component comprises a vent component sealing element which is externally activatable by non-mechanical means to effect sealing such that the gas permeable vent component becoming gas impermeable. In certain embodiments of such a sealable container the gas permeable vent component is disposed within in the container closure, while in other embodiments the gas permeable vent component is disposed anywhere within the container body.

Suitable materials for the fabrication of elements of the container body, container closures and/or gas permeable vent components of the present invention include a wide variety of materials, including, but not limited to, glasses, ceramics, metals, polymers and waxes as well as combinations thereof. Such combinations may be intimate combinations such as those obtained by blending of two or more components or laminates of two or more materials. Suitable waxes include natural plant and animal waxes, waxes produced by purification of petroleum and completely synthetic waxes as well as mixtures and combinations thereof.

Suitable polymers include rigid plastics, flexible plastics, thermoplastics, thermoset elastomers and thermoplastic elastomers as well as mixtures and combinations thereof. Suitable thermoplastics include polyolefins and particularly useful polyolefins include polyethylenes such as low-density polyethylene (LDPE), linear low-density polyethylene (LLDPE), medium-density polyethylene (MDPE), high-density polyethylene (HDPE) and ultra-high molecular weight polyethylene (UHMWPE). Other useful polyolefins include polypropylenes (PP), ethylene/propylene copolymers, polybutylenes, polymethylpentenes (PMP), ethylene/vinyl acetate copolymers (EVA), ethylene/vinyl alcohol copolymers (EVOH) and polyvinyl acetates as well as copolymers, mixtures and combinations thereof.

Other suitable thermoplastics are polyesters including, but are not limited to, polybutylene terephthalates (PBT); polyethylene terephthalates (PET), glycol modified polyethylene terephthalates (PETG), polylactides and polycarbonates as well as copolymers, mixtures and combinations thereof.

Still other suitable thermoplastics are polyethers including, but not limited to, polyalkylene glycols, ethylene glycols, polypropylene glycols, polybutylene glycols, polyetheretherketone (PEEK), polyacetals and cellulosics as well as copolymers, mixtures and combinations thereof.

Still other suitable polymers are vinyl polymers including, but not limited to, polystyrenes (PS), polyacrylonitrile (PAN), poly(acrylonitrile-butadiene-styrene) (ABS), poly (acrylonitrile-styrene-acrylate) (AES), poly(acrylonitrile-ethylene-propylene-styrene) (ASA), polyacrylates, polyacrylates, polymethacrylates, polymethylmethacrylate (PMMA), polyvinylchloride (PVC), chlorinated polyvinyl chloride (CPVC), polyvinyl dichloride (PVD), polyvinylidene chloride (PVDC), fluorinated ethylene propylene copolymer (FEP), polyvinyl fluoride (PVF), polyvinylidene fluoride (PVDF), polytetrafluoroethylene (PTFE) and poly (ethylene tetrafluoroethylene) (ETFE) as well as copolymers, mixtures and combinations thereof.

Other suitable polymers include, but are not limited to, polyamides such as nylon 6 and nylon 12, polyimides, polysulfones and polyethersulfones (PES) as well as copolymers, mixtures and combinations thereof.

Suitable thermoset elastomers include, but are not limited to, styrene-butadiene copolymers, polybutadienes, ethylene-propylene rubber (EPR), acrylonitrile-butadiene (NBR), polyisoprene, polychloroprene, silicone rubbers, fluorosilicone rubbers, polyurethanes, hydrogenated nitrile rubber (HNBR), polynorborene (PNR), butyl rubber, halogenated butyl rubber, such as chlorobutyl rubbers (CIIR) and bromobutyl rubbers (BIIR), commercially available fluoroelastomers such as Viton™, Kalrez™ and Fluorel™ and chlorosulfonated polyethylene as well as copolymers, mixtures and combinations thereof.

Suitable thermoplastic elastomers (TPE) include, but are not limited to, thermoplastic polyolefins (TPO) including those commercially available as DEXFLEX™ and INDURE™; elastomeric polyvinyl chloride blends and alloys such as ALCRYN™; styrenic block copolymers including styrene-butadiene-styrene (SBS), styrene-isoprene-styrene (SIS), styrene-isobuytlene-styrene (SIBS), styrene-ethylene/butylene-styrene (SEBS), and styrene-ethylene-propylene-styrene (SEPS), some of which are commercially available as KRATON™, DYNAFLEX™ and CHRONOPRENE™; thermoplastic vulcanizates (TPV), also known as dynamically vulcanized alloys, including those commercially available as VERSALLOY™, SANTOPRENE™ and SARLINK™; thermoplastic polyurethanes (TPU), including those commercially available as CHRONOTHANE™, VERSOLLAN™ and TEXRIN™; copolyester thermoplastic elastomers (COPE), including those commercially available as ECDEL™; and polyether block copolyamides (COPA) including those commercially available as PEBAX™, as well as copolymers, mixtures and combinations thereof.

Metals suitable for use in components of certain embodiments of the present invention include, but are not limited to, stainless steels, aluminum, zinc, copper, and silver as well as alloys, mixtures and combinations thereof.

Glass and ceramic materials suitable for use in certain embodiments of the present invention include, but are not limited to, quartz, borosilicates, aluminosilicates and sodium aluminosilicates. In certain preferred embodiments glass and ceramic materials are in the form of sintered particles or fibers.

A useful process for fabrication of macroporous plastics useful in embodiments of the present invention is sintering, wherein particulate (powdered or granular) thermoplastic polymers are subjected to the action of heat and pressure to effect partial agglomeration of the particles resulting in formation of a cohesive porous structure. Such porous material comprises a network of interconnected pores that form a random tortuous path through the structure. In such porous structures, the void volume or percent porosity is about 1 to 85% depending on the specific conditions of sintering. In certain embodiments a void volume or percent porosity range of 30 to 65% is preferred. Variations in material properties such as surface tension permits such porous materials can be tailored to repel or absorb liquids while permitting passage of air and other gases. U.S. Pat. No. 3,051,993 to Goldman, herein incorporated by reference in its entirety, describes a sintering process for making a porous polyethylene material.

In certain embodiments the porous matrix or porous membrane of the gas permeable vent component is by design fabricated from a material that is intrinsically hydrophobic, hydrophilic, oleophobic or oleophilic. In certain other embodiments the porous matrix or porous membrane of the gas permeable vent component is rendered hydrophobic, hydrophilic, oleophobic or oleophilic by surface treatments, including but not limited to, chemical treatment, plasma discharge, vapor deposition and the like.

Porous plastic materials suitable for certain embodiments of the porous vent components of the present invention are commercially available in sheets or molded forms under the trademark POREX™ from Porex Corporation (Fairburn, Ga., U.S.A.). The average porosity of such POREX™ materials can vary from about 1 to 350 microns depending on the size of polymer granules used and the conditions employed during sintering. Suitable porous plastic materials with pore sizes ranging from 5 to 1000 microns are available from the Gen-Pore division of General Polymeric Corporation (Reading, Pa.) while porous plastic materials with pore sizes ranging from 5 to 200 microns are available from MA Industries Inc. (Peachtree City, Ga.) as VYON™. Other Manufacturers of porous plastic materials suitable for certain embodiments of the sealable vent components of the present invention available as SINTERFLO™ from Porvair Technology Ltd (Wrexham North Wales, U.K.).

The size, thickness and porosity of porous vent elements necessary for the various embodiments of the present invention may be determined by determining the quantity of fluid required to pass through the vent over time (flow rate) in a given application. The flow rate for a given area of vent is also known as the flux rate. The flow or flux rates of a given porous plastic vary and depend on factors including pore size, percent porosity and cross sectional thickness of the vent. Flow rates are generally expressed in terms of volume per unit time while flux rates are generally expressed in terms of fluid volume per unit time per unit area. Therefore, the flow rate or flux rate required for the specific process to which it is applied. For example in a sealable vent component of the present invention used in a hot-fill process, the flow rate is chosen to be sufficient to permit the equalization of pressure between the container interior and the ambient atmosphere during cooling of the container after hot filling.

In certain embodiments the porous matrices or porous membranes of the vent components have a pore diameter range of 1 μm to 350 μm with 5 μm to 40 μm being preferred. While in certain other embodiments the porous matrices or porous membranes of the vent components have a pore diameter ranging from 0.01 μm to 5.0 μm with 0.05 μm to 2.0 μm preferred and 0.10 μm to 0.20 μm most preferred.

In certain preferred embodiments the gas permeable vent component is a porous matrix or membrane with a pore size sufficient to exclude common bacteria. Such an arrangement permits venting of the container, which prevents vacuum formation, while providing a sterile microbiological barrier from the manufacturing atmosphere. In such embodiments a porous matrix or membrane with a pore size less than 0.50 microns is preferred and a porous matrix or membrane with a pore size less than 0.25 microns is most preferred.

However, in such embodiments it is not necessary that the porous matrix have a bacteria excluding pore size throughout its thickness but rather it is sufficient that either the surface of the porous matrix exposed to the interior of the container body or the surface of the porous matrix exposed to the exterior environment has a pore size sufficient to exclude bacteria. Such an arrangement can be achieved by fabrication of porous matrix or membrane as a laminate structure wherein one or both surfaces have a layer of a bacteria excluding pore size material and the core portion of the matrix can have a greater pore size to facilitate venting.

Useful as vent component sealing compositions in embodiments of the present invention, are a variety of commercially available hot melt adhesives that are currently used in a wide range of manufacturing processes. In general, such hot melt adhesives are solvent-free adhesives, that are solid at temperatures below about 180° F., are low viscosity fluids above about 180° F. and that rapidly set or solidify upon cooling. Hot melt adhesives particularly useful for embodiments of the present invention include, but are not limited to, paraffin waxes, ethylene vinyl acetate (EVA) copolymers, styrene-isoprene-styrene (SIS) copolymers, styrene-butadiene-styrene (SBS) copolymers, ethylene ethyl acrylate copolymers (EEA) and the like, as well as mixtures and combinations thereof. Often these polymers do not exhibit the full range of performance characteristics required for a hot melt adhesive application and a variety of performance enhancing materials such as tackifying resins, waxes, antioxidants, plasticizers, and the like other materials are added to the adhesive formulation to enhance performance. Other thermoplastic adhesives useful in embodiments of the present invention are known as polyurethane reactive (PUR) adhesives. Such an adhesive composition contains a solid one-component urethane prepolymer that behaves like a standard hot melt wherein it reacts with adventitious moisture to effect crosslinking or chain extension to form a new polyurethane polymer. Such PUR systems often exhibit performance characteristics that are often superior to those of standard hot melts adhesives.

In embodiments wherein the vent component sealing compositions comprises a hot melt adhesive composition hermetic sealing is achieved by exposing the sealable vent to any suitable heat source.

In certain preferred embodiments the vent component sealing compositions is a hot melt adhesive composition that also comprises a suitable energy absorbing material and the hermetic sealing is achieved by exposing the sealable vent to an induction heating source. In such embodiments the energy absorbing material in the form of particles is admixed with the hot melt adhesive so that as the metallic particles are inductively heated adhesive melts. Useful energy absorbing materials for such embodiments include, but are not limited to electrically conducting metals, ceramics, carbon and the like as well as mixtures and combinations thereof. Particularly useful metals for use in these embodiments include, but are not limited to, iron, steel, aluminum, zinc, copper and silver as well as mixtures, combinations and alloys thereof.

In certain other preferred embodiments the vent component sealing compositions comprises a hot melt adhesive that is in intimate contact with a porous metallic foil or film and the hermetic sealing is achieved by exposing the sealable vent to an induction heating source. In such embodiments the adhesive melts as the metallic foil or film is inductively heated. Particularly useful metals for use in the porous metallic foil or film of these embodiments include, but are not limited to, iron, steel, aluminum, titanium, zinc, copper and silver as well as mixtures, combinations and alloys thereof. Other energy absorbing materials useful as components of foils or coated films useful in the present invention include, but are not limited to, various forms of electrically carbon as well as electrically conducting ceramics such as indium tin oxide.

Induction heating sources with wide range of frequencies are available and are useful in embodiments of the present invention. There is a relationship between the frequency of the RF field generated by the electromagnetic induction source and the depth to which it penetrates a material; low frequencies (up to 30 kHz) are effective for thicker materials requiring deep heat penetration, while higher frequencies (100 kHz to >800 MHz) are effective for smaller parts or shallow penetration. In general, the higher the frequency the greater is the heating rate for a particular material, for example, a frequency particularly useful for inductive heating of iron particles such as microparticles or nanoparticles is 800±100 MHz.

In certain embodiments wherein the porous fusible sealing element is externally activatable by an electromagnetic induction source operating at a frequency ranging from 5 kHz to 100 GHz. In certain preferred embodiments the fusible sealing element is externally activatable by an electromagnetic induction source operating at a frequency ranging from 5 kHz to 900 MHz. In yet certain other preferred embodiments the fusible sealing element is externally activatable by an electromagnetic induction source operating at a frequency ranging from 800 MHz to 100 GHz.

A variety of radiant-curable adhesives, which are suitable for use as vent component sealing compositions in embodiments of the present invention, are currently used in a wide range of manufacturing processes and are commercially available. In general, such radiant-curable adhesives are solvent-free adhesives that are rapidly cured when exposed to radiant energy such as ultraviolet (UV) and electron beam (EB) systems. Suitable UV light-curable adhesive compositions may include photoinitiators to activate the cure, wherein energy in the ultraviolet range of the spectrum (200-400 nm) is absorbed by the photoinitiators to achieve the rapid photochemical cure. Components of a UV light curing system generally include a light source that is usually a quartz lamp, a power supply, reflectors to focus or diffuse the light, cooling systems to remove heat and a conveyor system. EB-cured adhesives, though similar in function and performance to UV light-curable adhesives, generally do not require the use of a photoinitiator. Instead, an electron beam within the equipment exposes the adhesive composition to low-energy electrons, rapidly curing the composition. In general EB curing system include a control panel, a transformer for voltage and an electron accelerator. Radiant-curable adhesive compositions, which are suitable for use as vent component sealing compositions in preferred embodiments of the present invention, contain 100% solids and are volatiles-free.

In certain embodiments wherein the gas permeable vent component is disposed within the container closure, the closure is secured to the container body and the container is oriented during the filling process such that the container closure vent provides gaseous communication between the headspace of the liquid filled container body and the exterior environment. In FIG. 1 is illustrated an isometric view of such an embodiment wherein a sealable container 10 has a container body wall 11 with a container opening 12 and a container closure in the form of a container cap 14, wherein the cap 14 is threadedly mated to the container 10 at a threaded container neck 13. A sealable gas permeable vent component 15 is disposed within container cap 14.

Figure 2:
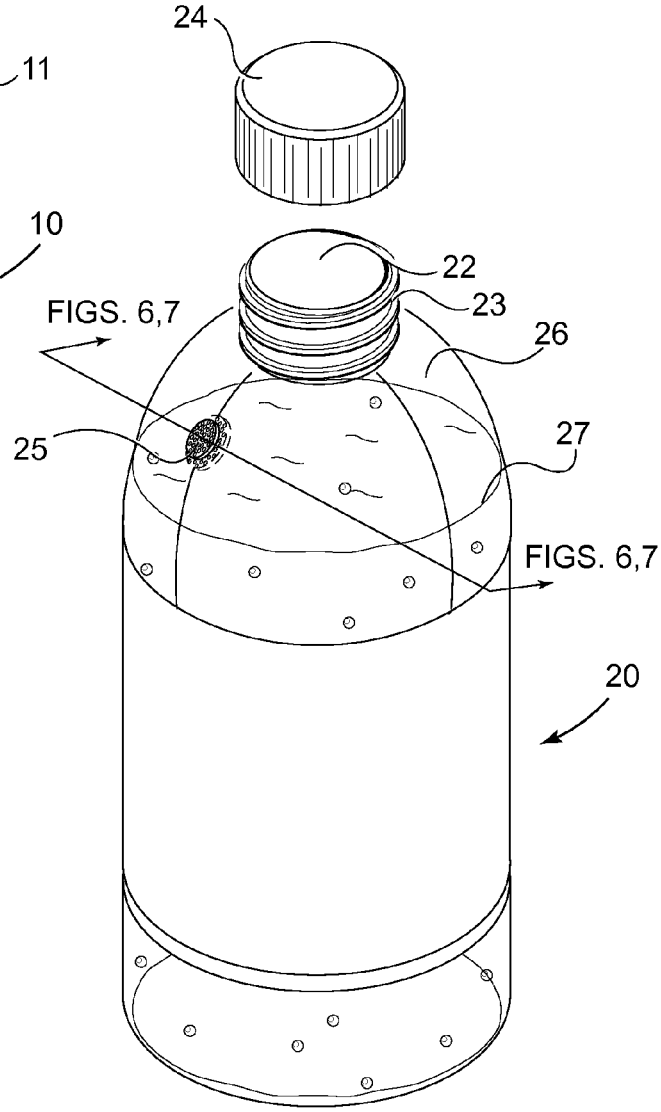
FIG. 2 depicts an isometric view of an embodiment of a sealable container wherein a sealable vent component is disposed within the container wall.

In certain embodiments wherein the gas permeable vent component is disposed within the wall of the container body, the sealable gas permeable vent component is oriented such that it provides gaseous communication between the headspace (volume above the liquid level) of a liquid filled container body and the exterior environment. In such embodiments the sealable gas permeable vent component may be located anywhere within the wall of the container body. In FIG. 2 is illustrated an isometric view of such an embodiment wherein a sealable container 20 has a container body wall 21 with a container opening 22 and a container closure in the form of a threaded container cap 24, wherein the cap 24 is threadedly mated to the container 20 at a threaded container neck 23. A sealable gas permeable vent component 25 is disposed within container body wall 21 which, when the container is utilized in a liquid hot-fill process, is oriented such that gaseous communication is provided between the exterior environment and the headspace 26 above a liquid level 27 of the liquid filled container 20.

In certain embodiments of the gas permeable vent component an energy absorbing material is dispersed therein or layered upon a porous matrix comprising a fusible material. Upon application of a suitable energy source, such an energy absorbing material transfers energy in the form of heat to the fusible material, wherein the fusible material fuses (melts or softens) porous matrix becomes non-porous and effects hermetic sealing of the container. In certain preferred embodiments the energy absorbing material contains a metal such as iron, steel, copper, silver, aluminum, titanium and zinc as well as alloys and mixtures thereof. In other preferred embodiments the energy absorbing material contains various forms of carbon or electrically conductive ceramics including, but not limited to, indium tin oxide. In such embodiments the porous matrix comprises a thermoplastic material and the energy source is an electromagnetic induction source. Upon application of the electromagnetic induction source the energy absorbing material is inductively heated to effect fusion of the thermoplastic material, wherein the pores of vent component are sealed through melt bonding and/or capillary filling. In certain embodiments the energy absorbing material comprises particles ranging from macroparticles to microparticles, which are incorporated into the thermoplastic material. In certain other embodiments the porous matrix of a container vent has a laminate structure comprising one or more fusible porous layers adjacent to one or more non-fusible porous layers. Alternately such a laminate structure comprises one or more first fusible porous layers adjacent to one or more second porous layers wherein the second porous layer comprises a fusible material with a melting point higher that that if the first fusible porous layer. In such systems hermetic sealing of the vent is achieved by the intrusion of a fusible porous layers into the pores of adjacent non-fusible or higher melting layer.

Figure 3:
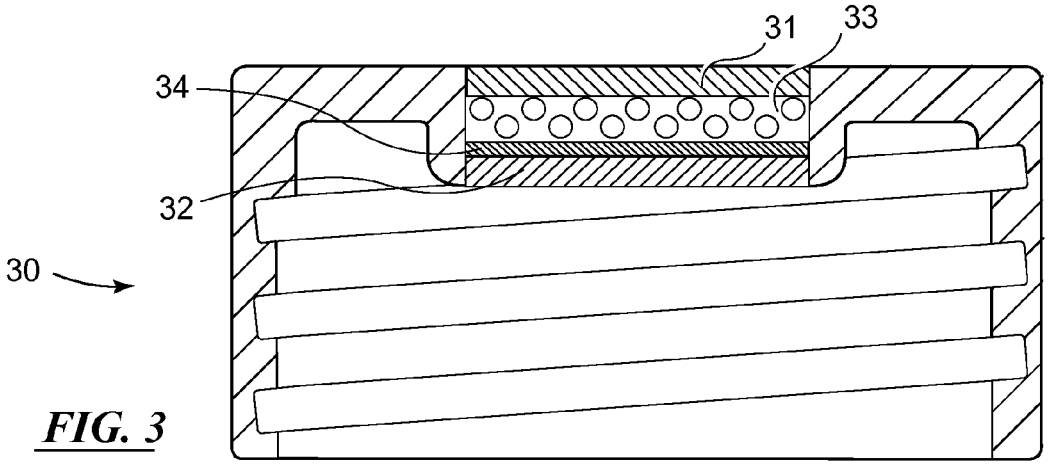
FIG. 3 depicts a sectional frontal orthographic view of an embodiment with a sealable vent component disposed within a threaded container cap.

Certain preferred embodiments of the sealable gas permeable vents of the present invention utilize a laminate structure comprising a first porous matrix, a porous metallic foil or film, a thermoplastic material and a second porous matrix. In a hot-fill process the porous metal foil is inductively heated wherein the thermoplastic intrudes into the pores of the porous metal foil and the second porous matrix resulting in a hermetic seal. One such embodiment is presented in FIG. 3 depicting a sectional front orthogonal view of a threaded container cap 30 having a sealable gas permeable vent component fixedly disposed within. In this embodiment the sealable gas permeable vent component has a laminate structure comprising a first porous matrix 31 in intimate contact with one surface of a porous thermoplastic sealing composition layer 33, while the opposite surface of the porous thermoplastic sealing composition layer 33 is in contact with one surface of a porous metallic foil or film 34 and the opposite surface of the porous metal foil 34 is contact with a second porous matrix 32. When utilized in a hot-fill process, the container is filled with liquid and the metal foil or film 34 is inductively heated by a suitable induction means until the thermoplastic sealing composition layer 33 sufficiently softens or melts, coalesces and flows through the pores of the porous metallic foil or film 34 and into the pores of the second porous matrix 32 to a depth sufficient to produce a hermetic seal. In such a process the softened or molten thermoplastic material 33 may also flow into the pores of the first porous matrix 31.

Figure 4:
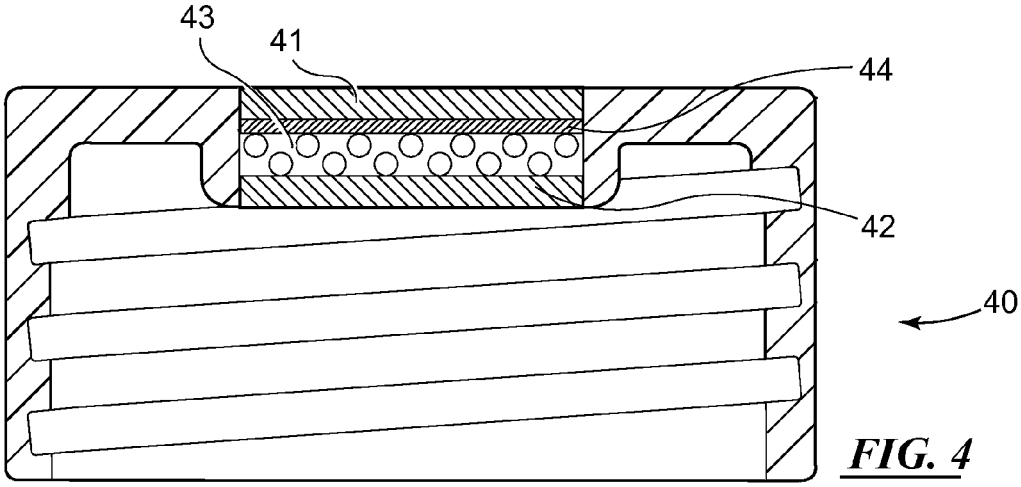
FIG. 4 depicts a sectional frontal orthographic view of an embodiment with a sealable vent component disposed within a threaded container cap.

Another such embodiment is presented in FIG. 4 depicting a sectional front orthogonal view of a threaded container cap 40 having a sealable gas permeable vent component fixedly disposed within. In this embodiment the sealable gas permeable vent component has a laminate structure comprising a first porous matrix 41 in intimate contact with one surface of a porous metallic foil or film 44 while the opposite surface of the porous metallic foil or film 44 is in contact with one surface of a porous thermoplastic layer 43 and the opposite surface of the porous thermoplastic layer 43 is contact with a second porous matrix 42. When utilized in a hot-fill process, the container is filled with liquid and the metallic foil or film 44 is inductively heated by a suitable induction means until the thermoplastic material 43 sufficiently softens or melts, coalesces and flows through the pores of the porous metallic foil or film 44 and into the pores of the second porous matrix 42 to a depth sufficient to produce a hermetic seal. In such a process the softened or molten thermoplastic material 43 may also flow into the pores of the first porous matrix 41.

Figure 5:
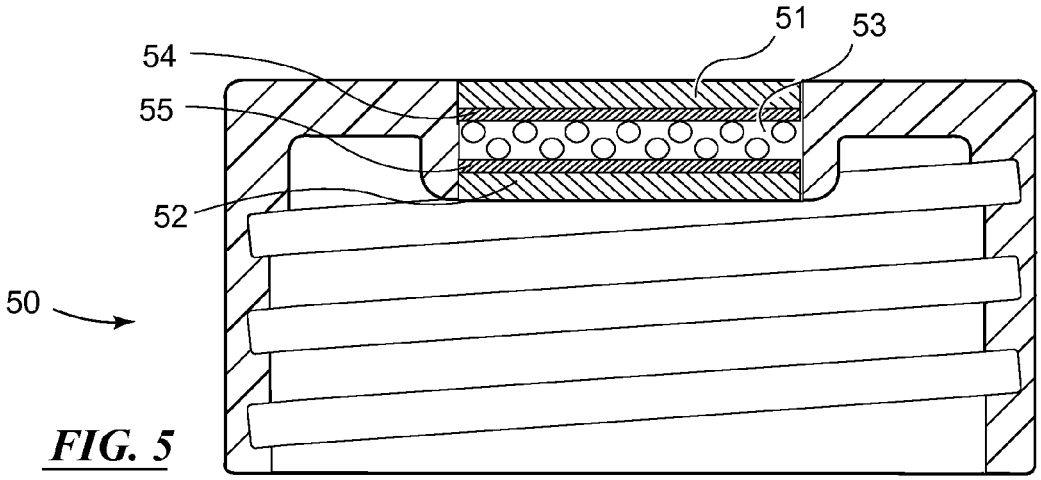
FIG. 5 depicts a sectional frontal orthographic view of an embodiment with a sealable vent component disposed within a threaded container cap.

Yet another such embodiment is presented in FIG. 5 depicting a sectional front orthogonal view of a threaded container cap 50 having a sealable gas permeable vent component fixedly disposed within. In this embodiment the sealable gas permeable vent component has a laminate structure comprising a first porous matrix 51 in intimate contact with one surface of a first porous metallic foil or film 54 while the opposite surface of the first porous metallic foil or film 54 is in contact with one surface of porous thermoplastic layer 53, the opposite surface of porous thermoplastic layer 53 is in intimate contact with a surface of a second porous metallic foil or film 55 and the opposite surface of porous metallic foil or film 55 is in intimate contact with a second porous matrix 52. When utilized in a hot-fill process, the container is filled with liquid and the metallic foil or film 54 and/or the metallic foil or film 55 is inductively heated by a suitable induction means until the thermoplastic material 53 sufficiently softens or melts, coalesces and flows through the pores of the porous metallic foil or film 54 and/or the metallic foil or film 55 and into the pores of the first porous matrix 51 and/or second porous matrix 52.

Figure 6:
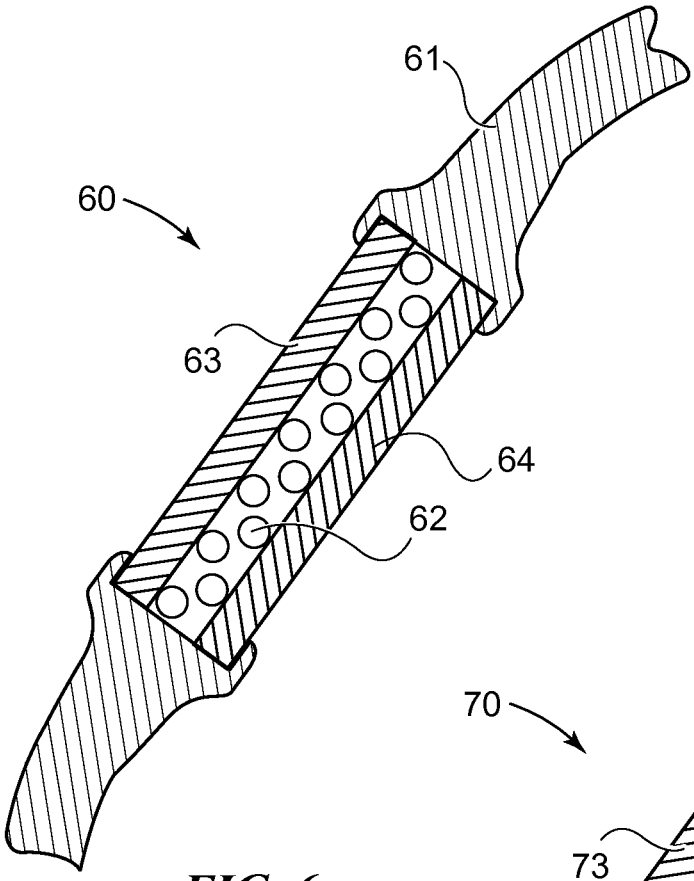
FIG. 6 depicts a sectional frontal orthographic view of an embodiment with a sealable vent component disposed within a wall of a container body.

In FIG. 6 is depicted an embodiment wherein a sealable gas permeable vent component 60, comprising a porous sealing layer 62 disposed between a first porous matrix 63 and a second porous matrix 64, is fixedly disposed within container body wall 61. In certain preferred embodiments, the sealing layer 62 comprises a porous thermoplastic, while in other preferred embodiments the sealing layer 62 comprises a porous radiant-curable adhesive.

Figure 7:
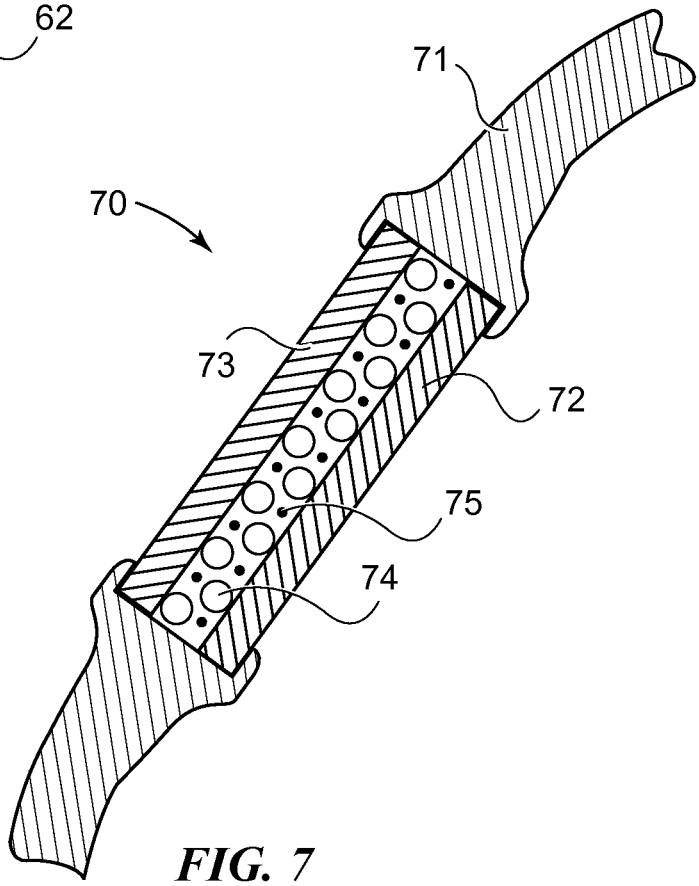
FIG. 7 depicts a sectional frontal orthographic view of an embodiment with a sealable vent component disposed within a wall of a container body.

In FIG. 7 is depicted an embodiment wherein a sealable gas permeable vent component 70, comprising a porous sealing layer 74 disposed between a first porous matrix 72 and a second porous matrix 73, is fixedly disposed within container body wall 71. In such embodiments, the porous sealing layer 74 is a thermoplastic material that contains an energy absorbing material such as a metal, ceramic or carbon in form of particles 75 dispersed throughout and wherein inductive heating effects hermetic seal.

Figure 8A:
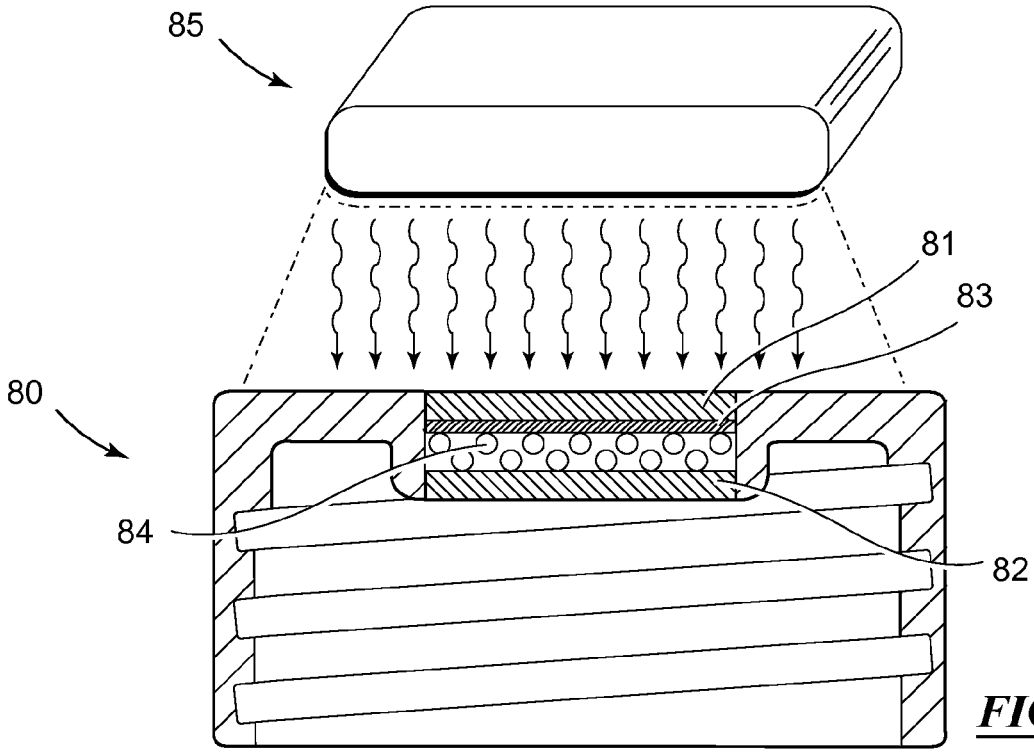
FIG. 8A depicts a sectional frontal orthographic view of a sealable vent component disposed within a threaded container cap positioned within the range of an induction heating means at the onset of induction heating.
Figure 8B:
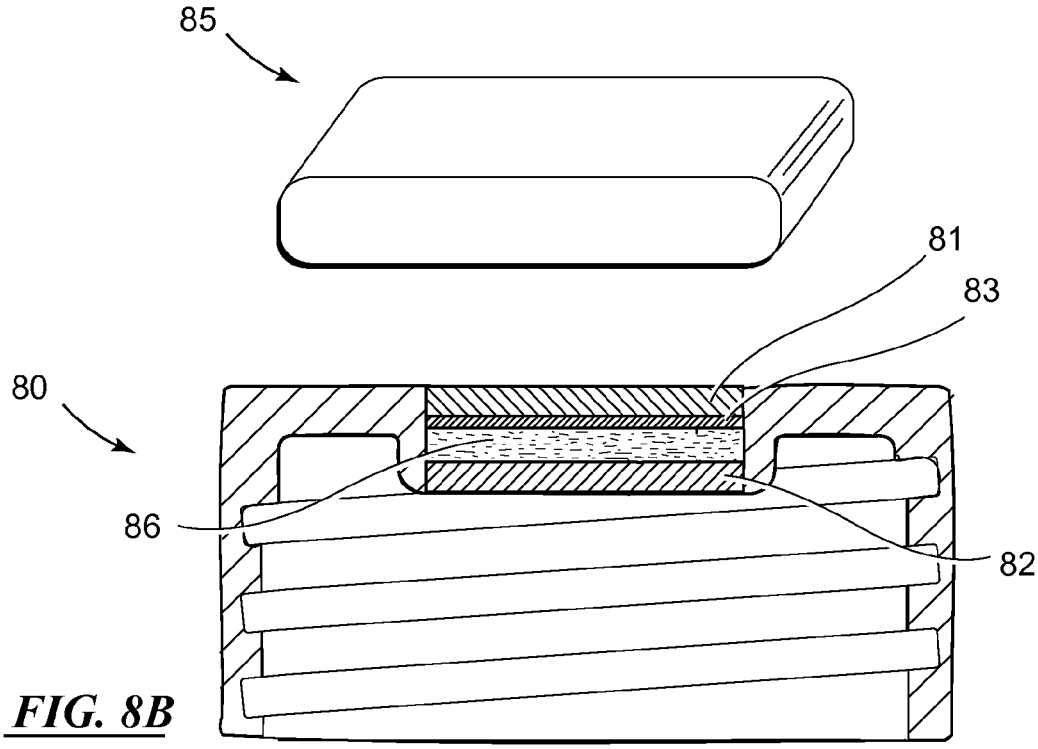
FIG. 8B depicts a sectional frontal orthographic view of a sealable vent component disposed within a threaded container cap after sealing with an induction heating means.

In FIG. 8A is depicted a sectional frontal orthographic view of a embodiment of the present invention wherein a sealable vent component comprising a laminate structure comprising a first porous matrix 81 in intimate contact with one surface of a porous metallic foil or film 83 while the opposite surface of the porous metallic foil or film 83 is in contact with one surface of a porous thermoplastic sealing composition layer 84 and the opposite surface of the porous thermoplastic layer 84 is contact with a second porous matrix 82. Wherein the sealable vent component is disposed within a threaded container cap 80 positioned within the range of an induction heating means 85 at the onset of a sealing process. In FIG. 8B is depicted the sealable vent component cap assembly of FIG. 8A after the induction heating sealing process wherein the thermoplastic sealing composition layer 86 has been sufficiently softened or melted to produce a hermetic seal.

In certain embodiments of the present invention the sealable vent comprises an externally activatable porous vent sealing composition in the form of a ring that is sized and positioned within a threaded container cap such that it is in contact with the interior top surface and interior annular surface of the container cap. When this container cap is threadedly secured to the neck of a mated container the ring is in intimate contact with the top surface of a threaded container neck. In such embodiments the threads of the container cap and the container neck are sized such that when the cap is secured to the container there is a sufficient thread gap between the cap threads and container neck threads to permit gaseous communication from the interior of the container through the porous sealing ring and through the thread gap to the exterior environment. When used in a hot fill process the container is filled with hot liquid; liquid in container is allowed to cool, during which time the pressure within the container and the external environment equilibrates; and the externally activating the vent sealing composition by non-mechanical means to effect hermetic sealing of the container cap to the container neck. In effect the annular porous vent-sealing element is transformed into a circular gasket or O-ring upon application of a suitable external activation means. As in other embodiments of the sealable vents of the present invention the porous vent sealing composition comprises a thermoplastic material such as a hot-melt adhesive, which in some embodiments may contain an energy absorbing material such as a metal, ceramic or carbon, and the external activation means is an induction heating means. As in certain other embodiments the energy absorbing material can be in form of particles dispersed throughout the porous fusible material. In yet other embodiments the energy absorbing material comprises a metal or metallic porous foil or metal coated film, which is disposed above the in the top of the cap and above the ring and is in intimate contact with the annular porous vent-sealing element. In other embodiments of the annular porous vent sealing composition comprises a radiant-curable adhesive and the external activation means is a radiant energy source such as ultraviolet (UV) light or an electron beam (EB). In embodiments wherein radiant energy is utilized the container cap is fabricated from materials that are transparent to the required radiant energy.

Figure 9:
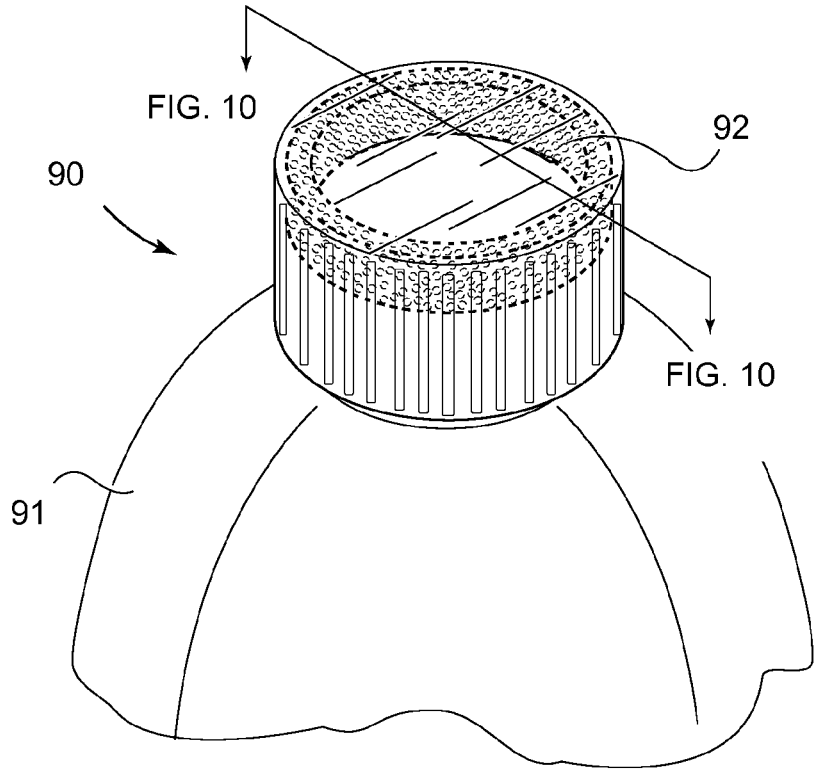
FIG. 9 depicts an isometric view of an annular sealable vent element disposed within a threaded container cap.
Figure 10:
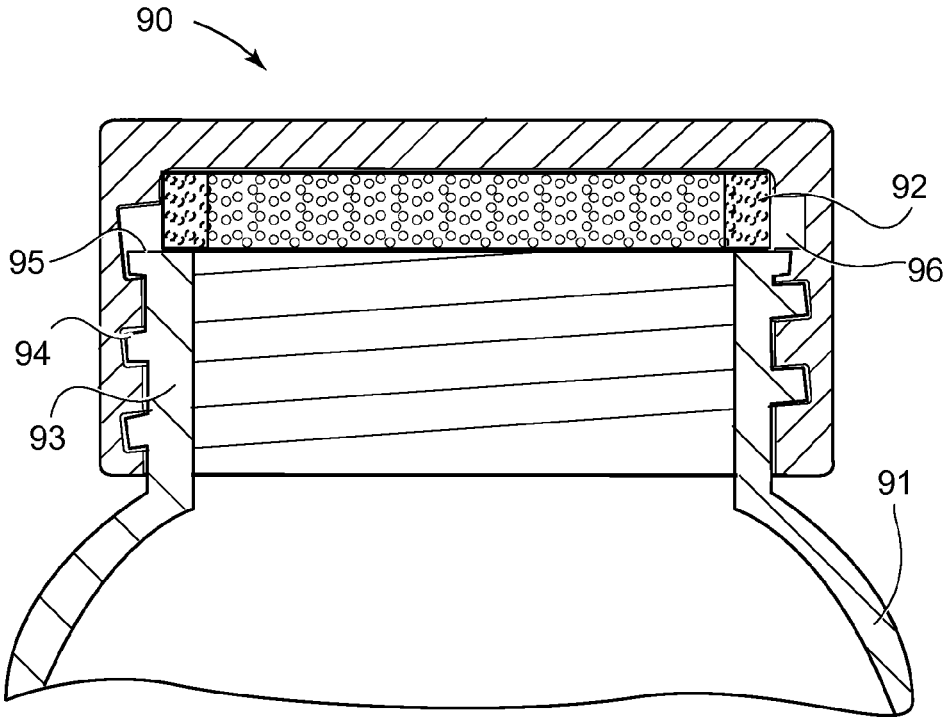
FIG. 10 depicts an orthographic sectional view of annular sealable vent element disposed within a threaded container cap.

Depicted in FIG. 9 is an isometric view of an embodiment wherein a threaded container cap 90 is threadedly secured to a container 91 and wherein a porous vent sealing composition in the form of a ring 92 is disposed within the cap 90. Depicted in FIG. 10 is a sectional orthogonal frontal view of the container cap 90 threadedly secured to container 91, which illustrates the relationship between the porous sealing ring 92, the cap 90 and the threaded neck 93 of the container 91. Also illustrated in FIG. 10 is a thread gap 94, a container neck lip 95 and a vent space 96, which form a gaseous vent path defined by the relative sized and geometries of the porous sealing ring 92, the cap 90 and the threaded neck 93. When used in a hot fill process the container 91 is filled with hot liquid; liquid in container is allowed to cool, during which time the pressure within the container and the external environment equilibrates by the gaseous communication through the path defined by the vent space 96, the porous sealing ring 92, and the thread gap 94; after which the porous sealing ring 92 is externally activated wherein it is rendered non-porous and effects hermetic sealing of the container.

Figure 11:
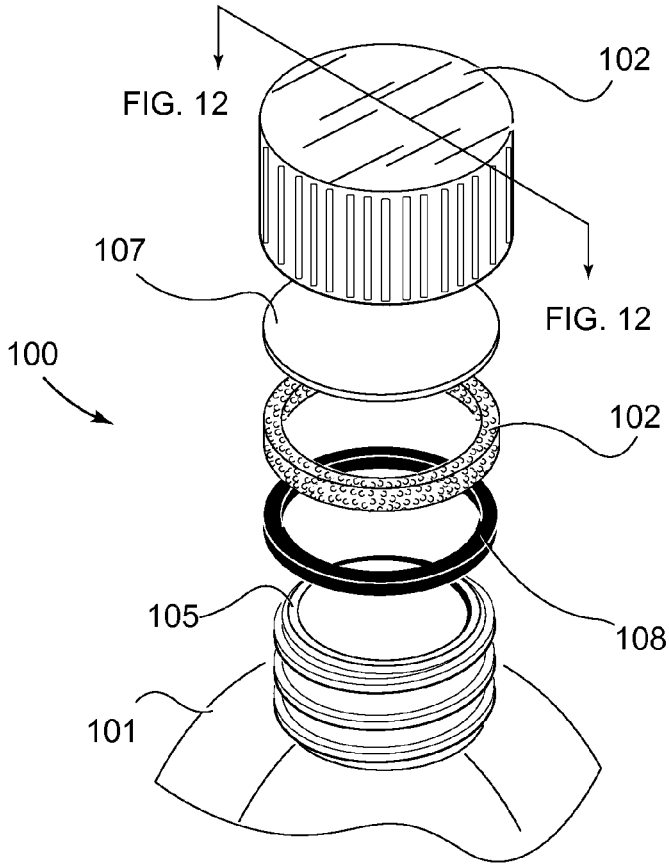
FIG. 11 depicts an exploded isometric view of an embodiment of a sealable container wherein an annular sealable vent component is disposed within the container cap.
Figure 12:
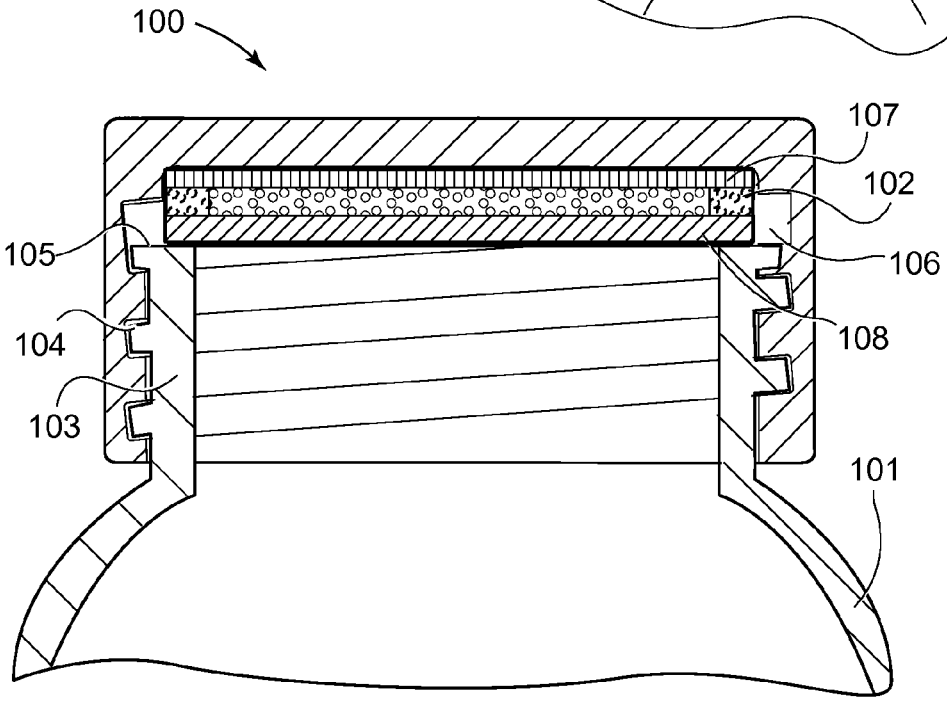
FIG. 12 depicts a sectional orthographic frontal view of the container cap of the embodiment of depicted in FIG. 11.

In certain other embodiments of the present invention the sealable container comprises a container body formed by a container wall defining an interior space and an exterior environment, wherein the container body comprises a threaded closable opening; a threaded container cap having interior top surface and interior annular surface wherein the threaded container cap is mated to the threaded closable opening; and a gas permeable vent in the form of a ring sized and positioned within the threaded container cap such that it is in contact with the interior top surface and interior annular surface of the container cap, wherein the gas permeable vent comprises a hot-melt adhesive vent sealing composition that is externally activatable by radiative means to effect hermetic sealing and wherein the container cap has a layer of metallic foil or film disposed between the container cap interior top surface and the gas permeable vent such that the metallic foil or film maintains intimate contact with the interior top surface of the container cap and with the vent sealing composition of the gas permeable vent. In certain preferred embodiments the gas permeable vent in the form of a ring comprises a bi-layer structure having a non-fusible porous layer and a vent material and an externally activatable vent sealing composition layer in intimate contact. In FIG. 11 is depicted an exploded isometric view of such an embodiment wherein the container cap assembly 100 consists of a threaded cap shell 102, in which is disposed a disk of metallic foil or film 103, a gas permeable vent externally activatable vent sealing element in the form of a ring 104 and an optional non-externally activatable gas permeable vent element in the form of a ring 105. In FIG. 12 is depicted a sectional frontal orthogonal view of the same embodiment illustrated by FIG. 11 wherein the container cap 100 is threadedly fixed to the container body 101. FIG. 12 clearly illustrates the relationship between the threaded cap shell 102, the disk of metallic foil or film 103, the gas permeable vent externally activatable vent sealing ring 104 and a non-externally activatable gas permeable vent ring 105. When such an embodiments is utilized in a hot fill process the container body 101 is filled with hot liquid; liquid in container is then allowed to cool, during which time the pressure within the container and the external environment equilibrates by the gaseous communication through the path defined by the vent space 109, the porous sealing ring assembly consisting of activatable vent ring 104 and non-activatable vent ring 105, and the thread gap 108; after which the cap is exposed to an induction heating means wherein the disk of metallic foil 103 is inductively heated to soften or melt the activatable porous sealing ring 104 wherein it is rendered non-porous and effects hermetic sealing of the container.

Although the invention has been disclosed in the context of certain embodiments and examples, it will be understood by those skilled in the art that the invention extends beyond the specifically disclosed embodiments and examples to other alternative embodiments and/or uses as well as obvious modifications and equivalents thereof.

We claim:

1. A sealable container comprising:

a container body formed by a container wall defining an interior space and an exterior environment; wherein the container body comprises a closable opening, a container closure mated to the closable opening and a gas permeable vent component, comprising a porous material providing gaseous communication between the interior space of the container body and the exterior environment, wherein the vent component further comprises a vent component sealing composition and an energy absorbing layer that is externally activatable by an electromagnetic induction source to effect hermetic sealing.

2. The sealable container of claim 1 wherein the gas permeable vent component is disposed within the container closure.

3. The sealable container of claim 1 wherein the gas permeable vent component is disposed within in the container wall.

4. The sealable container of claim 1 wherein the porous material comprises a porous membrane.

5. The sealable container of claim 1 wherein the porous material is hydrophobic.

6. The sealable container of claim 1 wherein the porous material is hydrophilic.

7. The sealable container of claim 1 wherein the porous material is oleophobic.

8. The sealable container of claim 1 wherein the porous material is oleophilic.

9. The sealable container of claim 1 wherein the porous material comprises a polymer.

10. The sealable container of claim 9 wherein the polymer comprises a polyolefin selected from the group consisting of polyethylenes polypropylenes, ethylene/propylene copolymers, polybutylenes, polymethylpentenes, copolymers thereof and combinations thereof.

11. The sealable container of claim 9 wherein the polymer comprises a copolymer selected from the group consisting of ethylene/vinyl acetate copolymers ethylene/vinyl alcohol copolymers, polyvinyl acetates and combinations thereof.

12. The sealable container of claim 9 wherein the polymer comprises a polyester selected from the group consisting of polyethylene terephthalates, polybutylene terephthalates, glycol modified polyethylene terephthalates, polylactides and polycarbonates as well as copolymers, mixtures and combinations thereof.

13. The sealable container of claim 9 wherein the polymer comprises a fluorinated polyolefin selected from the group consisting of polytetrafluoroethylene, ethylene propylene copolymer, polyvinyl fluoride, polyvinylidene fluoride, and poly(ethylene tetrafluoroethylene) as well as copolymers, mixtures and combinations thereof.

14. The sealable container of claim 9 wherein the polymer comprises a polysulfones or polyethersulfones.

15. The sealable container of claim 1 wherein the porous material has a pore diameter in the range of 1 μm to 350 μm.

16. The sealable container of claim 1 wherein the porous material has a pore diameter in the range of 5 μm to 40 μm.

17. The sealable container of claim 1 wherein the porous material has a pore diameter in the range of 0.05 μm to 2.0 μm.

18. The sealable container of claim 1 wherein the porous material has a pore diameter in the range of 0.10 μm to 0.20 μm.

19. The sealable container of claim 1 wherein the vent component sealing composition comprises a porous fusible material.

20. The sealable container of claim 19 wherein the porous fusible material is a thermoplastic.

21. The sealable container of claim 20 wherein the thermoplastic is a hot-melt adhesive.

22. The sealable container of claim 19 wherein the gas permeable vent component further comprises a non-fusible porous matrix or membrane disposed directly above or below and in intimate contact with the porous fusible material.

23. The sealable container of claim 1 wherein the vent component has a laminate structure comprising a first porous matrix and a second porous matrix wherein the vent component sealing composition is interposed there between.

24. The sealable container of claim 1 wherein the energy absorbing layer comprises a metal.

25. The sealable container of claim 24 wherein the metal is selected from the group consisting of iron, steel, aluminum, titanium, zinc, copper and silver.

26. The sealable container of claim 1 wherein the energy absorbing layer comprises conductive carbon or a conductive ceramic.

27. The sealable container of claim 1 wherein the electromagnetic induction source has a frequency from 5 kHz to 100 GHz.

28. The sealable container of claim 1 wherein the electromagnetic induction source has a frequency from 800 MHz to 900 MHz.

29. The sealable container of claim 24 wherein the metal is in the form of a porous metallic foil or film.

30. The sealable container of claim 1 wherein the porous material comprises a first porous matrix, the vent component sealing composition comprises a second porous matrix and wherein the vent component has a laminate structure comprising the first porous matrix, the second porous matrix and a porous metal foil disposed there between such that the first porous matrix and the second porous matrix maintain intimate contact with the porous metallic foil.

31. The sealable container of claim 1 wherein the vent component sealing composition comprises a radiant-curable adhesive.

32. The sealable container of claim 31 wherein radiant-curable adhesive is a UV light-curable adhesive.

33. A sealable container comprising: a container body formed by a container wall defining an interior space and an exterior environment; wherein the container body comprises a threaded closable opening, a threaded container cap having interior top surface and interior annular surface wherein the threaded container cap is mated to the closable opening; and a gas permeable vent in the form of a ring sized and positioned within the threaded container cap such that it is in contact with the interior top surface and interior annular surface of the container cap, wherein the gas permeable vent comprises a porous material and a vent sealing composition and an energy absorbing layer that is externally activatable by an electromagnetic induction source to effect hermetic sealing.

34. The sealable container of claim 33 wherein the vent sealing composition comprises a hot-melt adhesive.

35. The sealable container of claim 33 further comprising a layer of metallic foil or film disposed within the threaded container cap between the interior top surface and the gas permeable vent such that the metallic foil or film maintains in intimate contact with the interior top surface of the container cap and with the vent sealing composition of the gas permeable vent.

* * * * *